United States Patent [19]

Tanaka et al.

[11] Patent Number: 4,509,699

[45] Date of Patent: Apr. 9, 1985

[54] COMPRESSION CRUSHER HAVING AN OPTIMIZED JAW CONFIGURATION

[75] Inventors: Tsuyoshi Tanaka; Kazuhisa Yoshikawa, both of Kobe, Japan

[73] Assignee: Kabushiki Kaisha Kobe Seiko Sho, Kobe, Japan

[21] Appl. No.: 508,905

[22] Filed: Jun. 29, 1983

[30] Foreign Application Priority Data

| | | | |
|---|---|---|---|
| Jul. 15, 1982 | [JP] | Japan | 57-107846[U] |
| Oct. 19, 1982 | [JP] | Japan | 57-158453[U] |
| Oct. 19, 1982 | [JP] | Japan | 57-158450[U] |

[51] Int. Cl.[3] ..... B02C 1/10

[52] U.S. Cl. ..... 241/268; 241/291

[58] Field of Search ..... 241/207–216, 241/264–269, 259.1, 259.2, 259.3, 291

[56] References Cited

U.S. PATENT DOCUMENTS

| | | | |
|---|---|---|---|
| 129,784 | 7/1872 | Browne et al. | 241/268 |
| 1,708,562 | 4/1929 | Barton et al. | 241/266 |
| 2,264,915 | 12/1941 | Meister | 241/267 |

*Primary Examiner*—Mark Rosenbaum

*Attorney, Agent, or Firm*—Oblon, Fisher, Spivak, McClelland & Maier

[57] ABSTRACT

A compression type crusher which is adapted to compressingly crush feed material in a crushing chamber formed between movable and stationary crusher plates, the crusher being characterized in that the crushing chamber is shaped such that at least one of the side walls of the crushing chamber defined by the movable and stationary crusher plates inclines away from a vertical line in an inlet region of the crushing chamber and approaches the vertical line in an outlet region of the crushing chamber.

8 Claims, 12 Drawing Figures

COMPRESSION CRUSHER HAVING AN OPTIMIZED JAW CONFIGURATION

BACKGROUND OF THE INVENTION

1. Field of the Invention

This invention relates to improvements in compression type crushers such as cone crusher, gyratory crusher and jaw crusher, and more particularly to a crusher with a crushing chamber of an improved shape which can attain a high reduction ratio.

2. Description of the Prior Art

The reduction rate in a closed circuit of conventional crushers is at most about 5 to 6 owing to overcompression or blocking of material in the crushing chamber. The term "reduction ratio" as used in this specification means the dimensional ratio of the material before and after the crushing operation. In order to obtain a product of a given size, it has been the usual practice in the conventional crushing plants to process the material progressively through a number of stages, e.g., through first to third crushing stages. The improvement of the reduction ratio is a matter of great importance to the compression type crusher since it will lead to the reduction of the operation time and the enhancement of the operational efficiency. The conditions for the improvement of the reduction ratio include the fact that: (1) the material should be subjected to sufficient crushing forces; (2) the maximum size of the product should be reduced; (3) a material of a large size can be fed through the inlet of the crushing chamber; and (4) the crushing chamber can be filled with the material, permitting the so-called choke feed to ensure stabilized operation and higher efficiency. In order to satisfy these conditions, it is necessary to design the crushing chamber to be of a shape with a broad inlet and a narrow outlet, which is, however, unsuitable for application to conventional crushers in consideration of the drop in the production speed and the overcompression which would result from blocking of the crushing chamber by the feed material. Further, the quantity and speed of the oscillatory movement of the crusher plate need to be determined with consideration of the behavior of the material in the crushing chamber, in appropriate ranges which are contributive to the enhancement of the reduction ratio, in relation to the shape of the crushing chamber.

SUMMARY OF THE INVENTION

It is an object of the present invention to provide a crusher which can overcome the above-mentioned limits of reduction ratio in the conventional crushers, and, more specifically, which can attain a reduction ratio greater than 12.

A more specific object of the present invention is to provide a crusher with a crushing chamber which is formed in a particular shape determined in relation with the quantity and speed of the movable crusher plate and the behaviors of feed material in the crushing chamber.

It is another object of the present invention to provide a jaw crusher with a crushing chamber as mentioned above, which is further provided with an assembly for fixedly mounting a toggle seat block.

It is still another object of the present invention to provide a jaw crusher with an improved crushing chamber as mentioned above, which is further provided with a swing jaw opening mechanism for ejecting stuck material from the crushing chamber.

It is a further object of the present invention to provide a jaw crusher with an improved crushing chamber as mentioned above, which is further provided with a tension rod spring adjusting mechanism.

According to a fundamental aspect of the present invention, there is provided a compression type crusher which is adapted to compressingly crush feed material in a crushing chamber formed between movable and stationary crusher plates, the crusher being characterized in that said crushing chamber is shaped such that at least one of the side walls of the crushing chamber defined by the movable and stationary crusher plates inclined away from a vertical line in an inlet region and approaches the vertical line in an outlet region of the crushing chamber.

The above and other objects, features and advantages of the present invention will become apparent from the following description and the appended claims, taken in conjunction with the accompanying drawings which show by way of example some illustrative embodiments of the invention.

DETAILED DESCRIPTION OF THE PREFERRED EMBODIMENTS

Figure 1:
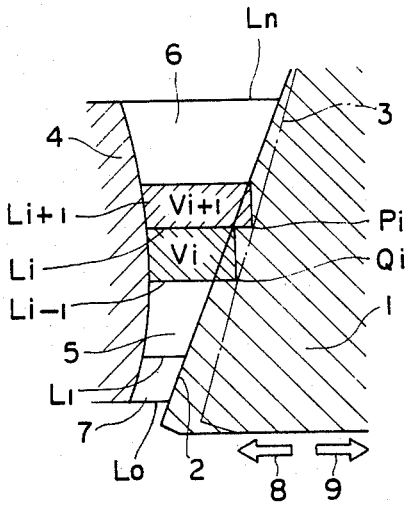
FIGURE 1 PRIOR ART
FIGS. 1 and 3 are diagrammatic sectional views of the crushing chamber of a conventional crusher.
Figure 2:
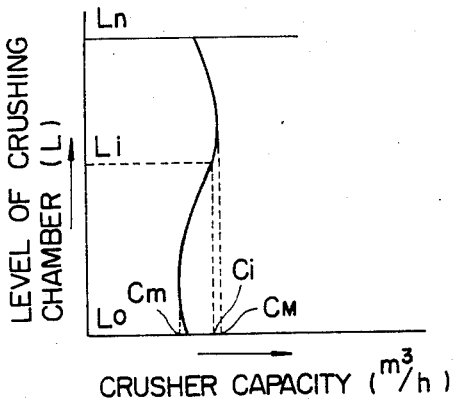
FIGURE 2 PRIOR ART
FIG. 2 is a diagram showing the relationship between the level of the crushing chamber and the crushing capacity.

The high reduction ratio attained by the construction according to the present invention is firstly explained by comparison with the conventional counterpart. Referring first to FIG. 1, there is diagrammatically shown a crushing chamber of a conventional cone crusher, including a movable crusher plate 1 which is reciprocally oscillated between a solid line 2 and a double-dot chain line 3 to compressingly crush rocks or other material which is fed into the crushing chamber between the movable crusher plate 1 and a stationary crusher plate 4 through an inlet 6. The crushed material is discharged through an outlet 7 at the bottom of the crushing chamber 5. Now, in explanation of the behaviors of the feed material, the crushing chamber 5 is divided by a plurality of horizontal planes, including a certain horizontal plane Li intersecting the solid line 2 at point Pi and a horizontal plane Li−1 containing a point of intersection Qi of the chain line 3 with a vertical line extending from the point of intersection Pi, defining a level $L_0$, a level $L_1$, a level Li . . . a level successively from the inlet portion of the crusher 5. The volume Vi+1 between the levels Li and Li+1 are compressed to Vi by the oscillatory motion of the movable crusher plate 1 in the direction of the arrow 8, and then dropped between the levels Li−1 and Li by the oscillatory motion in the direction of arrow 9. The crusher capacity C (e.g., $m^3/h$) as determined by the passing rate of the raw material which is crushed in the above-described manner has a distribution as shown in FIG. 2 at the respective levels of the crushing chamber. The maximum value $C_M$ of the crusher capacity C appears slightly inward of the inlet 6 of the crushing chamber, while the minimum value Cm exists slightly inward of the outlet 7. In order to permit choke feed, the value of $Cm/C_M$ has to be greater than 0.77, but experience teaches that it becomes difficult to satisfy the condition of $Cm/C_M \geqq 0.77$ if the displacement and speed of the oscillatory motion become too large. The reason for this is now explained by way of FIG. 3 in which the crushing plates 1 and 4 are formed in flat planes for the simplification of explanation. In this instance, the stationary crushing plate 4 is considered to be disposed in a vertical plane and the movable crushing plate 1 is inclined by an angle $\theta$ with respect to a vertical line. The crushing chamber 5 has a width S1 at the level L1 and a width Si at the level Li. The levels $L_1$ and $L_0$ and the levels Li and Li−1 are spaced from each other by distances $h_1$ and $h_i$, respectively, through which the material is dropped by the oscillatory movement of the crushing plate 1. More specifically, the material is dropped freely through the distance $h_i$ by the oscillatory movement after it is crushed at the level $L_i$, taking a time $t_i$ which has a relationship with the distance $h_i$ as expressed by the following equation $$h_i = \frac{1}{2} g t_1^2$$

wherein g is the gravitational acceleration. Therefore, the dropping time is $$t_i = \sqrt{2h_i/g} \text{ (second)}$$

and the speed N of oscillatory motion which can attain the drop of that amount is $$N = 60/\left(\frac{t_i}{2}\right) \text{ (rpm) } (i)$$

Figure 3:
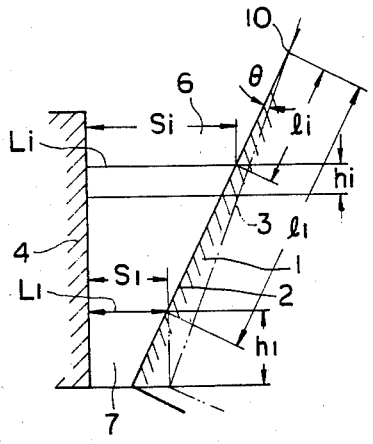
FIGURE 3 PRIOR ART

As seen in FIG. 3, the dropping distances $h_1$, $h_2$ . . . in the illustrated example are increased stepwise toward the outlet 7 of the crushing chamber. Therefore, if the speed of oscillatory motion is determined on the basis of the dropping distance $h_i$ at the level Li, the material at the level $L_1$ is gripped again between the crushing plates 1 and 4 without dropping by the distance $h_1$. Accordingly, a high speed oscillatory motion will result in a lower crushing capacity $Cm/C_M$ at the outlet portion of the crushing chamber. This is the reason why the crusher capacity $Cm/C_M$ is lowered when the speed of the oscillatory motion is raised an excessive degree. The distance $h_i$ is determined by the amount of the radial displacement, namely, the oscillatory displacement of the crusher plate 1 about an upper fulcrum point 10, the extent of the radial displacement increasing toward the outlet of the crusher chamber along with the dropping distance h. Thus, it will be easily understood that the increase in the amount of the radial displacement reduces the crusher capacity $Cm/C_M$ similarly to the speed of oscillatory movement. Consequently, since the production speed is determined by neither the speed nor the amount of the oscillatory movement, it is disadvantageous to hold them at excessively low values.

The above-discussed theory relative to the speed and displacement of the oscillatory motion is applicable only to a crushing chamber of the shape as shown in FIG. 3, and it is considered that the appropriate ranges of the speed and amount of oscillatory movement change depending upon the shape of the crushing chamber.

Nextly, considerations are given to the influences of the shape of the crushing chamber on the reduction ratio to determine the ideal shape of the crushing chamber. The width Si at the level Li of the crushing chamber shown in FIG. 3 is $$Si = S_1 + (l_1 - l_i)\cos\theta$$

which $l_i$ is the length of the crushing chamber from the fulcrum point 10 to the level Li. On the other hand, the crusher capacity Ci at the level Li is expressed by $$Ci = H \cdot Si \cdot hi = H \cdot [Si + (l_1 - l_i)\cos\theta] \cdot hi$$

while the crusher capacity $C_1$ at the level $L_1$ is expressed by $C_1 = H.S_1.h_1$. If the oscillatory speed N in Eq. (i) is set at $N = 60/(t_i/2)$, $h_1 = h_i$, and accordingly the ratio $Ci/C_1$ is expressed by $$Ci/C_1 = \frac{S_1 + (l_1 - l_i)\cos\theta}{S_1} = 1 + \frac{(l_1 - l_i)\cos\theta}{S_1}$$

Thus, if the gap width at the outlet of the crusher chamber is narrowed, that is to say, if the value of $S_1$ is minimized for improvement of the reduction ratio, the value of $Ci/C_1$ becomes greater and the value of its invested ratio $C_1/Ci$ becomes smaller. In a case where $C_1 = Cm$ and $Ci = C_M$, difficulties are encountered in maintaining $Cm/C_M \geqq 0.77$ when the outlet gap width S is reduced, as will be understood from the foregoing equation. Therefore, it is conceivable to increase the angle $\theta$ to a value close to 90° to minimize the value of $Ci/C_1$ of the equation given above. However, if it should entail minimization of the value S, minimization of the ratio $Ci/C_1$ becomes impossible. The condition of $Cm/C_M \geqq 0.77$ can be attained without varying the value of $S_1$, by increasing the angle $\theta$ toward the inlet of the crushing chamber. Namely, a crushing chamber which can comply with these conditions should have be shaped such that its side wall surface is inclined away from a vertical line in the inlet portion and gradually inclined toward the vertical line in the outlet portion. A crushing chamber with such a shape is ideal for the improvement of the reduction ratio since it can meet all of the conditions which are required in this regard, including a broad inlet, a narrow outlet, the condition of $C_M/Cm \geqq 0.77$ which has to be complied with to permit choke feed, and application of sufficient crushing force on the feed material.

Figure 4:
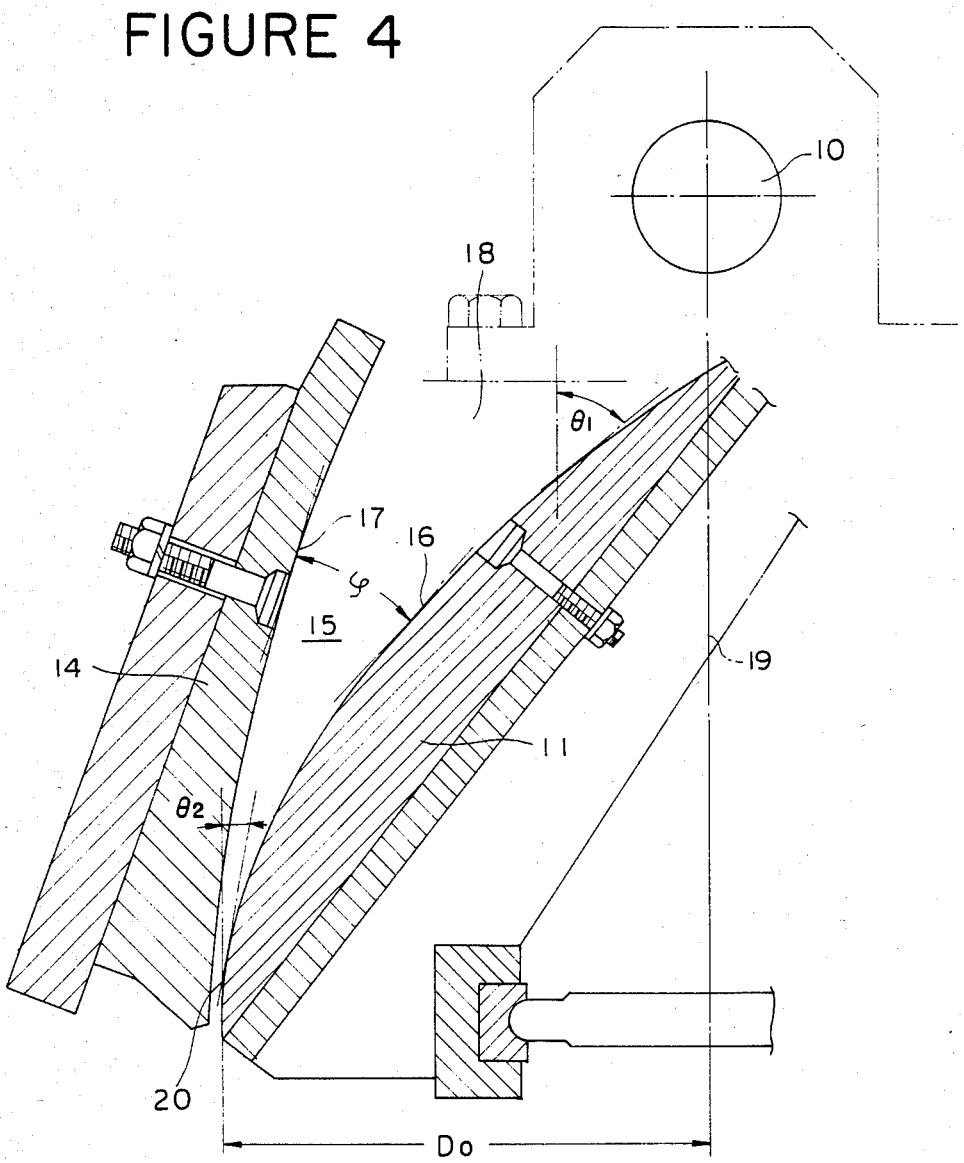
FIG. 4 is a diagrammatic sectional view of a jaw crusher embodying the present invention.

FIG. 4 illustrates in section a crushing chamber of a jaw crusher embodying the present invention, in which indicated by reference number 11 is a movable crusher plate or jaw which is rockable about a fulcrum point 10, a stationary crusher plate or jaw 14, and a crushing chamber in the form of a gap space 15 defined between the movable and stationary crusher plates 11 and 14. The side surfaces of the crushing chamber 15, more specifically, the side surface 16 on the part of the movable crushing chamber 11 and the side surface 17 on the part of the stationary crusher plate 14 are shaped such that they are inclined in the inlet region away from a vertical line extending through the fulcrum point 10 and gradually come closer to each other in the outlet region of the crushing chamber 15. In this instance, however, the angle of inclination of the side surface 16 at the inlet 18 of the crushing chamber should not be too small since otherwise the value of CM will become smaller than Cm (Cm>CM), lowering the capacity of the crusher itself. Therefore, the angle of inclination should be determined in a range which will hold the ratio of Cm/CM at a value not smaller than 0.77. To this end, the angle of inclination $\theta_1$ in the inlet region 18 is preferably in the range of 45° to 55°, while the angle of inclination $\theta_2$ in the outlet region 20 is preferred to be in the range of 0° to 10°. The angle $\psi$ which is formed between the side surfaces 16 and 17 on the movable and stationary crusher plates is desired to be smaller than 27° from the standpoint of preventing slips of the feed material on the side surfaces.

Figure 5:
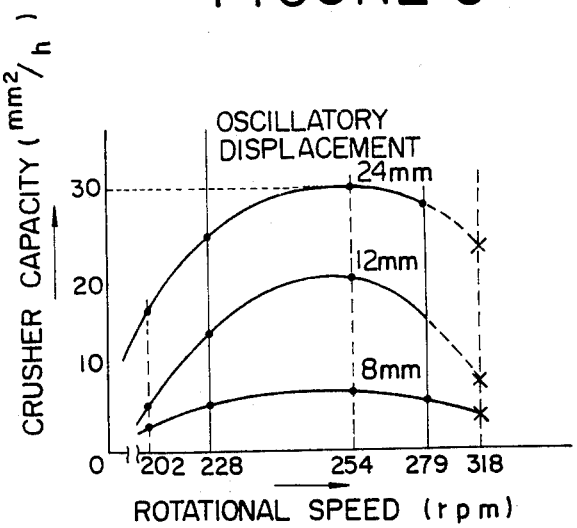
FIG. 5 is a diagram of crushing capacity plotted in relation with the width and speed of rocking motion.

FIG. 5 shows the relationship between the displacement and speed of the oscillatory motion obtained from the results of actual operations of a double-toggle type jaw crusher with a crushing chamber of the above-defined shape and a mantle diameter of 1200 mm, crushing raw material with a size of $d_1=250$ mm into a size of $d_2=20$ mm, thus at the reduction ratio of $d_2/d_1=12.5$. As clear from FIG. 5, the crusher capacity reaches its peak when the speed of the oscillatory motion is in the range of 228–279 rpm, and overcompression occurs at higher speeds. The safety device is disrupted due to overcompression if the quantity of the oscillatory motion exceeds 30 mm. The optimum value of the oscillatory motion is in the range of 12 to 24 mm. In the case of a crushing chamber of the conventional shape, the safety device was actuated under all of the conditions shown in FIG. 5 to stop the crushing operation. Upon studying the appropriate range of the oscillatory displacement or the speed of the oscillatory rotation in relation to the dimension D corresponding to the mantle diameter, it is understood that the oscillatory displacement is in the range of $(0.01\times0.03)\times D$ mm and the speed of the oscillatory rotation is in the range of $(9650\text{–}7600)/\sqrt{D}$ rpm. Although not shown in the drawing, these facts were confirmed in other experiments. The above-described shape of the crushing chamber according to the invention is applicable to other rotational crushers such as the single toggle jaw crusher or the like in addition to the double toggle jaw crusher exemplified in the foregoing embodiment. The term "dimension corresponding to the mantle diameter" as used in this specification means the diameter of the mantle itself in the case of a cone crusher, and double the dimension $D_0$ of FIG. 4 in the case of a jaw crusher.

Figure 6:
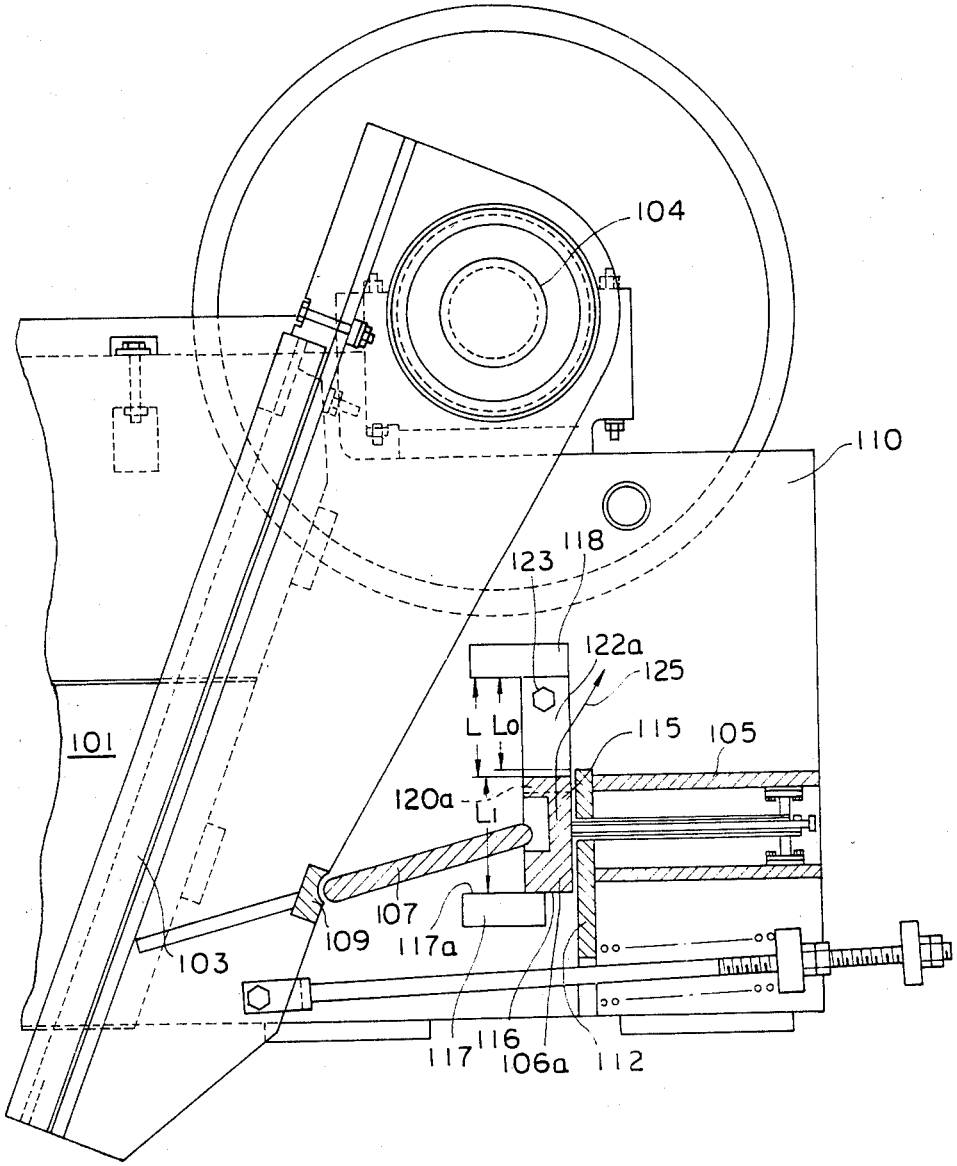
FIGS. 6 and 7 are a sectioned side elevational and a rear view of a toggle seat block fixing construction according to the invention, respectively.
Figure 7:
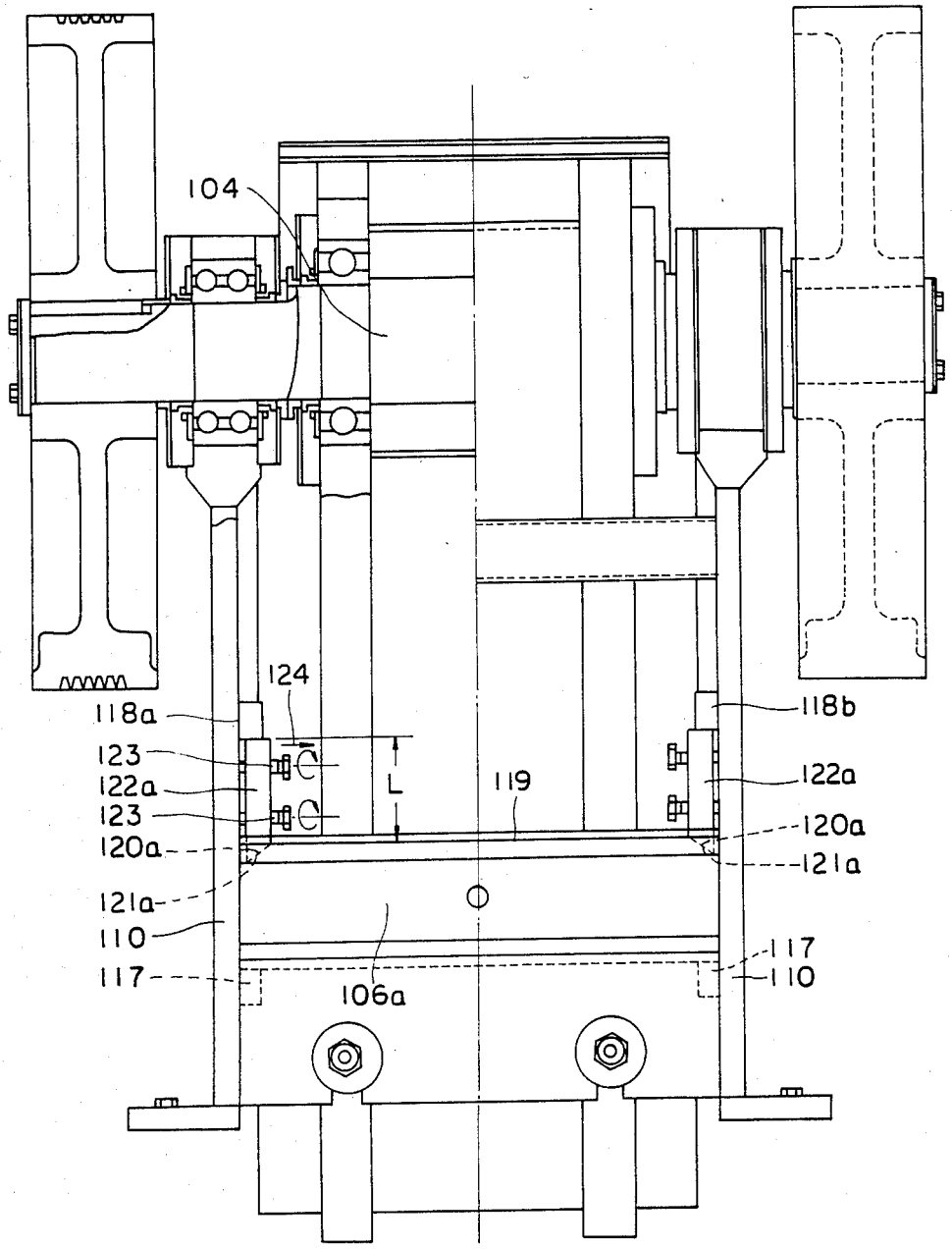

In addition to the crushing chamber of the above-defined shape, it is preferred to provide a toggle seat block fixing construction as shown in FIGS. 6 and 7 in the case of a toggle jaw crusher. More specifically, as shown in those figures, a toggle seat 109 of a swing jaw 103 and a toggle seat 108 of a toggle seat block **106*a* is linked by a toggle plate 107 the rear side of which is abutted against a front vertical surface 112 of a back frame 105 or against a spacer 115 provided along the front vertical surface 112. Fixedly mounted on the inner surfaces of side plates 110 which cover the opposite lateral sides of the swing jaw 103 are block-like support members 117 which are in abutting engagement with the bottom surface 116 of the toggle seat block 106*a* to support the latter from beneath. The upper surfaces of the support members 117 also serve as guide surfaces for the back-and-forth movements of the toggle seat block 106*a*. Further, a guide member 118 is fixedly mounted on the inner surface of each side frame 110 in a position which is located at a predetermined distance L from the upper end of the toggle seat block 106*a*. The upper surface of the toggle seat block 106*a* which opposes the lower surface of the guide member 118 are provided with tapered surfaces 120*a* at the left and right end portions, the tapered surfaces 120*a* being inclined in the leftward and rightward directions, respectively. Fitted between each guide member 118 and the tapered surface 120*a* is a rectangular plate-like wedge member 122*a* which is provided with a tapered surface 121*a* on its lower side, with the same taper angle as that of the opposing tapered surface 120*a* of the toggle seat block 106*a*. Threaded laterally into each wedge member 122*a* are screws 123 which constitute a sort of shifting screw mechanism, increasing the distance between the side frame 110 and the wedge member 122*a* upon tightening the screws 123, pushing down the toggle seat block 106*a* against the lower support member 117 by the wedge action of the tapered surfaces 120*a* and 121*a*. The distance Lo between the upper end of the back frame 105 and the lower side of the support member 118 is set at a length smaller than the height $L_1$ of the toggle seat block 106*a***.

Therefore, as the right-hand shift screws 123 are tightened by turning same clockwise as indicated by arrows in FIG. 7, the wedge member **122*a* is pressed inward of the machine frame as indicated by arrow 124, bringing the tapered surfaces 120*a* and 121*a* into sliding contact, and shifted toward a position between the tapered surface 121*a* and the lower surface of the guide member 118*a*, grippingly fixing the toggle seat block 106*a* between the guide member 118*a* and support member 117 through the wedge member 122*a*. On the other hand, in order to remove the toggle seat block 106*a*, the wedge member 122*a* is pushed in a direction opposite to the arrow 124 after loosening the shift screws 123*a*, and removed from the position between the toggle seat block 106*a* and the guide member 118*a* (the same applied to the wedge member 122*a* which is mounted on the right side of the machine). Then, the toggle seat block 106*a* is lifted up by a crane or other suitable means, using the free space of the width lo, to dismantle the toggle seat block 106*a* from the machine. The position of the toggle seat block 106*a* can be adjusted in the forward or rearward direction by changing the thickness of the spacer 115**.

Figure 8:
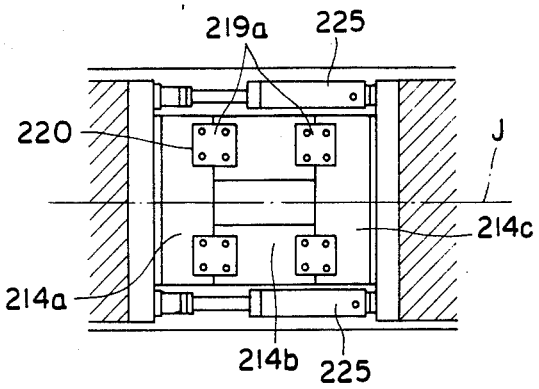
FIG. 8 is a diagrammatic plan view of a swing jaw opening mechanism according to the invention, employing a separable toggle plate and a couple of hydraulic cylinders.
Figure 9:
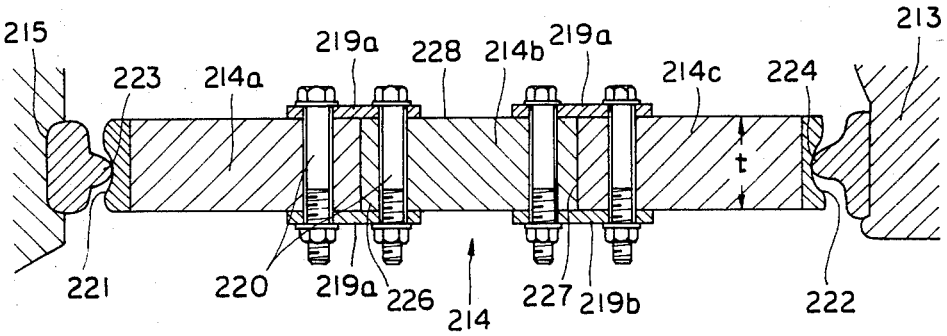
FIG. 9 is a diagrammatic sectional view of the toggle plate taken on line A—A of FIG. 8.

In a crushing operation by a jaw crusher, there sometimes occurrs difficulty in removing hard rocks which are stuck between the crusher plates due to the hardness of rocks far exceeding the crushability of the machine, requiring a worker to get into the crushing chamber to remove the rocks manually from upper ones. This is very dangerous and uneconomical in view of the large time losses which are incurred before restoration of a normal operation. In order to facilitate such rock-removing jobs on such occasions, a first toggle plate which is connected to a drive rod to impart rocking motions to a swing jaw is preferred to be constituted by a plurality of separable blocks. More particularly, in an example shown in FIGS. 8 and 9 the first toggle plate 214 is constituted by three blocks 214*a* to 214*c* which are connected in series by means of a number of bolts 220 passing through connecting plates 219*a* and 219*b* which are disposed on opposite sides of the blocks 214*a* to 214*c*. The end faces 221 and 222 of the leftmost and rightmost blocks 214*a* and 214*c* are provided with a concave surface of an arcute shape in section. As is clear from FIG. 9, abutted against the curved concave end faces 221 and 222 are projections 223 and 224 which are provided at the lower fulcrum point 215 of the swing jaw 201 and at the lower end 213 of a drive rod 212, respectively. The first toggle plate 214 is rockably retained between the projections 223 and 224 by means of a compression spring 207. Mounted at opposite sides of the first toggle plate 214 are a pair of hydraulic piston-cylinders 225 which are disposed parallel with the axis J of the first toggle plate 214 and each have one end thereof connected to the swing jaw 201 on the side of the lower fulcrum point 215 and the other end to the lower end of the drive rod 212. In a case where a pair of hydraulic cylinders are provided at opposite sides of the first toggle plate 214 in this manner, the pressures of the hydraulic cylinders are applied uniformly when separating the blocks by the cylinder operation as will be described hereinlater, facilitating the removal of the blocks 214*a* to 214*c*. If desired, a single piston-cylinder may be provided in alignment with the axis of the first toggle plate 214. Although not shown in the drawings, there is no necessity for using separable blocks for the second toggle plate. Since the blocks 214*a* to 214*c* are directly subjected to the compressive force to be applied to the feed material, they should have a sufficient thickness t from the standpoint of strength, and their joint faces 226 and 227 should be disposed at right angles with the top surface 228 to let the compressive force act peripendicularly on the joint faces 226 and 227.

If rocks with a hardness beyond the compressive crushing ability of the crusher are fed into the crushing chamber when the swing jaw 201 is driven by the eccentric rotation of the drive shaft 210, the prime mover as well as the swing jaw 201 is stopped in the middle of the compressing cycle due to the inability of breaking the hard rocks. On such an occasion, the drive wheel is slightly rotated in a reverse direction by manual operation to retract the swing jaw 201 a little to thereby loosen the compressive force of the swing jaw relative to the feed material in the crushing chamber. Nextly, the bolts 220 which connect the first toggle plate 214 are loosened in preparation for the disassembling of the toggle plate. In this state, the toggle plate 214 is not disassembled due to the compressive force of the compression spring 207 acting in the axial direction of the toggle plate. Upon actuating the cylinders 225, the swing jaw 201 is rocked to a slight degree in the compressing direction since the compressive force on the feed material has been slightly loosened, releasing the toggle plate 214 from the compressive force to permit the operator to lift up and remove the middle block 214*b* of the toggle plate 214. At this time, from the standpoint of safety and smooth operation in the subsequent stage, it is desirable to suspend the end blocks 214*a* and 214*c* by the use of a pully and a wire or other suitable means to prevent them from falling under the force of gravity. After removing the middle block 214*b* in this manner, the swing jaw 201 is fixed in position solely by the pressure of the hydraulic cylinders 225, so that it is swung backward (in the releasing direction) as the fluid pressure of the hydraulic cylinders 225 is gradually lowered, broadening the outlet gap width of the crushing chamber to drop off the stuck material. Thus, the blocking rocks can be easily removed in an extremely short time period. In order to restore the operating condition, the hydraulic cylinders 225 are actuated to rock the swing jaw 201 forward in the compressing direction, and the middle block 214*b* is inserted between the end blocks 214*a* and 214*c* and fixed to the latter by the bolts. The crushing operation may be recommenced as soon as the blocks are assembled into a unitary toggle plate.

Figure 10:
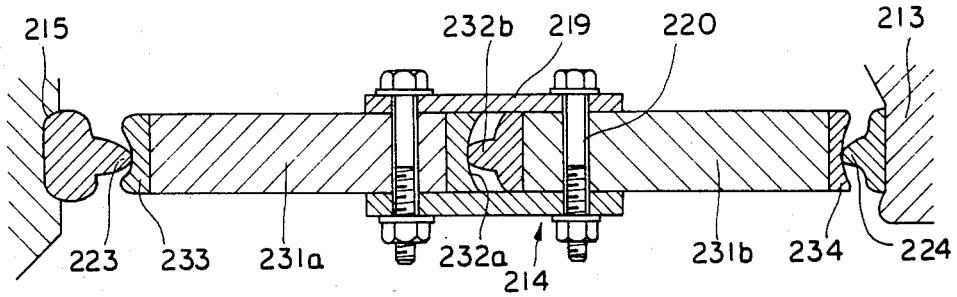
FIG. 10 is a diagrammatic sectional view of a bisected toggle plate.

FIG. 10 illustrates a modified construction of a separable toggle plate which can be divided into a couple of blocks. In this case, a projection 232*b* is provided on the joining end face of one block 231*b* while a concave surface 232*a* provided on the opposing joint end face of the other block 231*a* for rolling engagement with the projection 232*b*. By joining the two blocks 231*a* and 231*b* in this manner, the toggle plate can be folded in the middle portion and separated if necessary without changing the positions of the rear ends 233 and 234 of the respective blocks.

Figure 11:
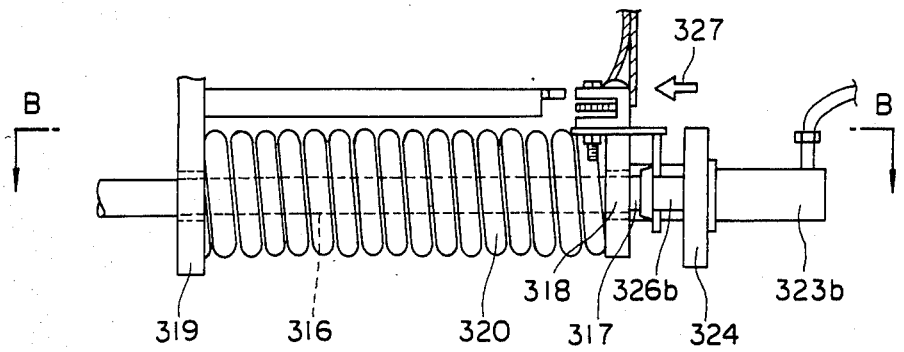
FIG. 11 is a diagrammatic side view of a tension rod spring adjusting mechanism according to the invention.
Figure 12:
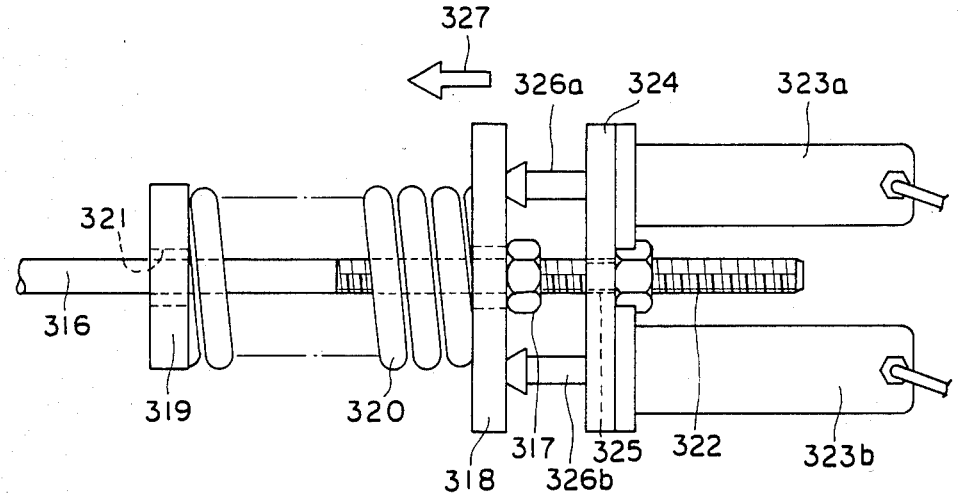
FIG. 12 is a view taken in the direction of line B—B of FIG. 11.

Further, in the case of a jaw crusher, it is preferred to provide a tension rod spring adjusting mechanism as shown in FIGS. 11 and 12 in order to facilitate the adjustment of the tension rod spring. As shown particularly in FIG. 11, a tension bolt 316 is loosely fitted in an open hole formed horizontally through a fixed plate 319 secured to a machine frame, and a tension rod spring 320 is retained in a compressed state between the fixed plate 319 and an adjusting plate 318 the position of which is adjustable by means of an adjusting nut 317 threaded on a screw portion 322 in the rear end portion of the tension bolt 316.

On the other hand, a cylinder mounting plate 324 which supports vertically thereon a pair of hydraulic cylinders 323*a* and 323*b* is centrally provided with a female screw portion 325 for threaded engagement with the screw portion 322 of the tension bolt 316. The cylinders 323*a* and 323*b* are mounted on the cylinder mounting plate 324 in such positions that, when the cylinder mounting plate 324 is threaded on the screw portion 322, the piston rods 326*a* and 326*b* of the cylinders 323*a* and 323*b* are abutted against the surface of the adjusting plate 318 according to the extent of extension of the respective cylinders.

The above-described adjusting mechanism is operated in the following manner to adjust the biasing force of the tension rod spring 320. In the first place, the cylinder mounting plate 324 with the cylinders 323*a* and 323*b* is threaded into a suitable position on the tension rod 316 as shown in FIGS. 11 and 12, and then the hydraulic cylinders 323*a* and 323*b* are actuated to extend the respective piston rods 326*a* and 326*b* in the compressing direction as indicated by arrow 327, thereby pushing the pressure adjusting plate 318 forward to compress the tension rod spring 320. As a result, the adjusting nut 317 is freed from the pressure of the tension rod spring 320, so that it can be easily turned by application of a small force to tighten or loosen the same into an arbitrary position. After shifting the adjusting nut to an appropriate position, the fluid pressure of the hydraulic cylinders 323*a* and 323*b* are lowered, so that the pressure adjusting plate 318 is pushed into abutting engagement with the adjusting nut 317 by the action of the tension rod spring 320 to set the tension rod spring in an appropriate compression length. Where there should arise a necessity for removing the tension rod spring 320, the nut 317 is shifted rearward in the same manner to weaken the compressive force of the tension rod spring, and then the adjusting nut 317 is removed from the screw portion 322 to free the tension rod spring 320.

Although a couple of hydraulic cylinders are employed in the example shown in FIGS. 11 and 12, three or more similar hydraulic cylinders may be used to ensure that the pressure adjusting plate is supported in a more stabilized state by the piston rods.

As clear from the foregoing description, the crusher according to the present invention can attain a high reduction ratio, for example, a reduction ratio of 12 by one-stage operation, in contrast to the conventional crushers which require two or more crushing stages in order to accomplish the corresponding reduction ratio, thus permitting simplication of the crushing process and enhancement of the operational efficiency. Further, the present invention rationalizes the crusher construction by employing, in combination with the crushing chamber of the improved shape, the above-described toggle seat block fixing mechanism, the swing jaw opening mechanism and/or the tension rod spring adjusting mechanism.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A compression type crusher which is adapted to crush feed material, said crusher comprising:

(a) a generally vertically oriented stationary crusher plate having a working surface;

(b) a generally vertically oriented pivotable crusher plate having a working surface;

(c) the working surfaces of said stationary and pivotable crusher plates defining a crusher chamber therebetween, said crusher chamber having an inlet region and an outlet region;

(d) said pivotable crusher plate being mounted for oscillatory pivotable movement about a fulcrum located above said crusher chamber;

(e) the entire working surface of one of said crusher plates being convex and shaped such that, in the inlet region, it is inclined away from the vertical axis by an angle of between 45° and 55°, its angle from the vertical gradually and continuously decreases in the downward direction, and, in the outlet region, it is inclined away from the vertical by an angle of between 0° and 10°;

(f) the entire working surface of the other one of said crusher plates being concave; and (g) the angle between the working surfaces of said stationary and pivotable crusher plates being less than 27° in the inlet region of the crusher chamber and decreasing gradually and continuously in the downward direction.

2. A compression type crusher as recited in claim 1 wherein:

(a) the inlet region of said crusher chamber includes a mantle having a diameter D and (b) the crusher further comprises a drive mechanism for oscillating said pivotable crusher plate such that points on the working surface of said pivotable crusher plate move a distance in the range of 0.01D to 0.02D and the speed of the oscillatory movement of said pivotable crusher plate is in the range of 9650 divided by the square root of D rpm to 7600 divided by the square root of D rpm.

3. A compression type crusher as recited in claim 1 wherein said crusher is a jaw crusher.

4. A compression type crusher as recited in claim 3 and further comprising:

(a) a back frame;

(b) a toggle seat block, a toggle plate, and a toggle seat block fixing means mounted on said back frame for supporting crushing forces transmitted through said toggle plate to said back frame, said toggle seat block fixing means comprising:

(i) a support member abutted against a support surface on said toggle seat block for supporting said toggle seat block;

(ii) a fixed guide member;

(iii) a wedge member located between said support surface on said toggle seat block and said fixed guide member; and (iv) a shift mechanism for shifting said wedge member along said fixed guide member into a wedging position between said fixed guide member and said support surface on said toggle seat block.

5. A compression type crusher as recited in claim 4 wherein said wedge member has a tapered surface which engages a correspondingly tapered surface on said toggle seat block.

6. A compression type crusher as recited in claim 3 wherein said drive mechanism comprises:

(a) a drive rod and (b) a toggle plate means connected to a lower end portion of said drive rod for converting reciprocatory motion of said drive rod into oscillatory privotable motion of said pivotable crusher plate, said toggle plate being composed of:

(i) a plurality of separable blocks and (ii) at least one fluid cylinder disposed in parallel to the axis of said toggle plate means, said at least one cylinder being operable to permit disassembly of said plurality of separable blocks to thereby permit removal of feed material stuck in said crushing chamber.

7. A compression type crusher as recited in claim 3 and further comprising:

(a) a frame;

(b) a pressure adjusting plate;

(c) a tension bolt;

(d) an adjusting nut threadedly mounted on an end portion of said tension bolt, said adjusting nut abutting against and limiting the movement of said pressure adjusting plate;

(e) a fixed plate securely mounted on said frame;

(f) a tension rod spring interposed in a compressed state between said pressure adjusting plate and said fixed plate; and (g) means for adjusting the compression force of said tension rod spring.

8. A compression type crusher as recited in claim 7 wherein said means comprise:

(a) a cylinder mounting plate threadedly mounted on said tension bolt and (b) at least one fluid cylinder interposed between said cylinder mounting plate and said pressure adjusting plate, said at least one fluid cylinder serving to press said pressure adjusting plate away from said adjusting nut while said adjusting nut is turned on said tension bolt, thereby adjusting the compression length of said tension rod spring.

* * * * *